US006488472B1

(12) United States Patent
Miyazawa

(10) Patent No.: US 6,488,472 B1
(45) Date of Patent: Dec. 3, 2002

(54) AXIAL FAN, CENTRIFUGAL FAN, AND ELECTRONIC EQUIPMENT EMPLOYING ONE OF THESE FANS

(75) Inventor: Atsushi Miyazawa, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/769,263

(22) Filed: Jan. 26, 2001

(30) Foreign Application Priority Data

Jan. 28, 2000 (JP) ..... 2000-020813

(51) Int. Cl.[7] ..... F04D 29/28; F04D 29/38

(52) U.S. Cl. ..... 416/144; 416/203; 416/237

(58) Field of Search ..... 416/203, 500, 416/175, 144, 145, 185, 186 R, 237; 415/119

(56) References Cited

U.S. PATENT DOCUMENTS 3,736,811 A * 6/1973 Neary ..... 416/144
4,900,228 A * 2/1990 Yapp ..... 416/183
5,000,660 A * 3/1991 Van Houten et al. ..... 415/119
5,478,201 A * 12/1995 Amr ..... 415/119

FOREIGN PATENT DOCUMENTS

JP 5-231394 9/1993

OTHER PUBLICATIONS

"Design of Fan, and Noise"; Materials at Technical Seminar; Matsushita Inter–Techno Co., LTD.

* cited by examiner

*Primary Examiner*—Edward K. Look
*Assistant Examiner*—Kimya N McCoy
(74) *Attorney, Agent, or Firm*—Oliff & Berridge, PLC

(57) ABSTRACT

A low-noise axial fan is provided with whirring sound minimized. The axial fan includes a plurality of blades arranged around a rotation axis at predetermined layout pitches. The blades are arranged at varied layout pitches. For instance, the layout pitch between the two adjacent blades may be different from the layout pitch between the remaining blades. This arrangement controls the whirring sound of the fan, which would be high in level if the blades were arranged at an equal layout pitch. A low-noise axial fan thus results.

14 Claims, 14 Drawing Sheets

AXIAL FAN, CENTRIFUGAL FAN, AND ELECTRONIC EQUIPMENT EMPLOYING ONE OF THESE FANS

BACKGROUND OF THE INVENTION

1. Field of Invention

The present invention relates to an axial fan which includes a plurality of blades arranged at a predetermined pitch about a rotation axis, and which takes in air in the direction of the rotation axis and discharges the air by rotating the plurality of the blades about the rotation axis. Further, the present invention relates to a centrifugal fan which includes a plurality of blades arranged at a predetermined pitch about a rotation axis, and which takes in air in the direction of the rotation axis and discharges air in a direction tangential to the rotation of the plurality of the blades by rotating the plurality of the blades about the rotation axis. The axial fan or the centrifugal fan may be used as an intake fan or an exhaust fan for electronic equipment such as a computer or projector.

2. Description of Related Art

Electronic equipment, such as a personal computer or a projector, conventionally employs an intake fan that cools the electronic equipment by taking in air from outside the electronic equipment and by having air impinge on the heat generating component, or an exhaust fan that outwardly discharges hot air from within the electronic equipment. As the intake fan or the exhaust fan, an axial fan and a centrifugal fan are available.

The axial fan has a plurality of fans arranged at a predetermined pitch around the rotation axis. By rotating the plurality of the blades about the rotation axis, air is taken in and discharged in the direction of the rotation axis.

The centrifugal fan has a plurality of fans arranged at a predetermined pitch around the rotation axis. By rotating the plurality of the blades on the rotation axis, air is taken in the direction of the rotation axis and discharged in a direction tangential to the rotation of the plurality of the blades.

Such an axial fan or centrifugal fan is arranged over a microprocessor unit forming a computer, or in the vicinity of a liquid-crystal display panel as an electro-optical device forming a projector or a lamp as a light source system in the projector. By having cooling air impinge on these heat generating components or discharging hot air out, efficient cooling is attained.

SUMMARY OF THE INVENTION

The axial fan installed in the electronic equipment conventionally employs five to eleven blades having the same shape and arranged about a rotation axis at a predetermined equal pitch.

The axial and centrifugal fans, provided with the blades having the same shape and arranged at the predetermined equal pitch, suffer from wind noise caused by the flow of air and a whirring sound unique to the fan. For instance, when an axial fan having nine blades arranged around a rotation axis at an equal pitch is rotated at a rotational speed of 4000 rpm, a whirring sound of 4000/60×9 (Hz) is generated. Since nine is not a prime number, a whirring sound of 4000/60×3 (Hz), attributed to a divisor of 3 for 9, is also generated.

The whirring sound becomes noise when the electronic equipment is in use, and a user may be uncomfortable with such noise. There is a need for a fan having low whirring sound level.

It is an object of the present invention to provide an axial fan and a centrifugal fan, featuring at least low-noise characteristics with low whirring sound level, and electronic equipment employing these fans.

An axial fan according to various exemplary embodiments of the present invention introduces the layout diversity of the blades, thereby lowering the level of whirring sound. The whirring sound would be high if a plurality of equally spaced blades were rotated. Specifically, the following methods are implemented.

An axial fan of an exemplary embodiment of the present invention includes a plurality of blades arranged around a rotation axis at a predetermined layout pitch. The plurality of the blades are rotated about the rotation axis to take in air in the direction of the rotation axis and to discharge the air. Some of the plurality of the blades are different from the remaining blades in shape thereof projected onto a plane perpendicular to the rotation axis.

Here, the clause "some of the plurality of the blades are different from the remaining blades in the shape thereof projected onto a plane perpendicular to the rotation axis" means that the width dimension of some blades is different from the width dimension of the remaining blades if viewed in the direction of the rotation axis. The shape of some blades is made different from the shape of the remaining blades by expanding an opening angle of the blades with respect to the rotation axis or by reducing a bending angle of the blade.

Since some of the plurality of the blades are different from the remaining blades in the shape thereof projected onto a plane perpendicular to the rotation axis in this exemplary embodiment, the layout diversity around the rotation axis is introduced. The whirring sound may be lower in level, compared with that which is caused by the blades having the same shape and arranged at an equal pitch. A low-noise axial fan may thus result.

An axial fan according to another exemplary embodiment of the present invention includes a plurality of blades arranged around a rotation axis at a predetermined layout pitch. The plurality of the blades are rotated about the rotation axis to take in air in the direction of the rotation axis and to discharge the air. Some of the plurality of the blades are different from the remaining blades in the cross-sectional shape taken in a plane in which the rotation axis lies.

The clause "some of the plurality of the blades are different from the remaining blades in the cross-sectional shape taken in a plane in which the rotation axis lies" means that the cross-sectional shape of some blades is made different from that of the remaining blades by setting some blades to be greater or smaller than the remaining blades in the angle of each blade made between a plane perpendicular to the rotation axis and a cross-sectional shape of the blade.

Since some of the plurality of the blades are different from the remaining blades in the cross-sectional shape, the layout diversity around the rotation axis is introduced in the same manner as in the previous embodiment. The whirring sound may thus be lower in level, compared with that which is caused by the blades having the same shape and arranged at an equal pitch. A low-noise axial fan may thus result.

An axial fan according to another exemplary embodiment of the present invention includes a plurality of blades arranged around a rotation axis at a predetermined layout pitch. The plurality of the blades are rotated about the rotation axis to take in air in the direction of the rotation axis and to discharge the air. Some of the plurality of the blades are different from the remaining blades in the layout pitch thereof.

The clause "some of the plurality of the blades are different from the remaining blades in the layout pitch thereof" means that, for instance, some of the nine blades are arranged around the rotation axis at a pitch of 30° or 50°, while the remaining blades are arranged on the rotation axis at a pitch of 40° degrees.

Since some of the plurality of the blades are different from the remaining blades in the layout pitch in this exemplary embodiment, the whirring sound may thus be lower in level, compared with that which is caused by the blades having the same shape and arranged at an equal pitch. A low-noise axial fan may thus result.

In this exemplary embodiment, from among the plurality of the blades, a pair of blades arranged to be generally diametrically symmetrical with respect to the rotation axis preferably have substantially the same layout pitch.

Specifically, if a first blade is changed in the layout pitch thereof in a nine-blade axial fan, a fifth blade, which is diametrically oppositely arranged across the rotation axis, is also equally changed in the layout pitch thereof.

Without greatly impairing the weight balance around the rotation axis of the axial fan, this arrangement may prevent clattering noise from being generated by the eccentricity of the axial fan during the rotation of a drive motor, thereby relieving a large load on the drive motor.

In the above-described exemplary embodiments, the number of the plurality of the blades is preferably a prime number.

Specifically, if the number of blades of an axial fan is 8 or 9, which is divisible by divisors 2 and 3 or 4, the whirring sound attributed to the divisors 2 and 3 or 4 is generated in addition to the whirring sound of the number of the blades. With the number of the blades of the fan set to a prime number, the whirring sound attributed to the divisors may be prevented. The low-noise characteristic of the axial fan may be even more enhanced.

In the above-described exemplary embodiments, the axial fan preferably includes an eccentricity adjusting device for adjusting weight balance around the rotation axis.

The eccentricity adjusting device can be formed by symmetrically arranging weights diametrically opposite with respect to the rotation axis where blades varied in planar shape, cross-sectional shape, or layout pitch are mounted. Specifically, the axial fan, formed of a plastic mold, includes a plurality of blades and a blade support member rotatably supported about the rotation axis. A projection or a notch is formed on the blade support member at the symmetrical positions diametrically opposite with respect to the rotation axis where the blades having different planar shapes are mounted. The weight balance is thus assured to compensate for the varied blades.

The axial fan thus has the eccentricity adjusting device. Even if some blades are varied in planar shape, cross-sectional shape, or layout pitch, the eccentricity adjusting device may assure the weight balance of the plurality of the blades and the blade support member around the rotation axis, thereby preventing a load from acting on the drive motor.

The above-referenced inventions are implemented not only in the axial fan but also in the centrifugal fan. The same operation and advantages will be enjoyed even if the above-referenced inventions are implemented in the centrifugal fan. The centrifugal fan refers to the one which includes a plurality of blades, arranged around a rotation axis at a predetermined layout pitch, wherein air is taken in the direction of the rotation axis and discharged in a direction tangential to the rotation of the plurality of the blades, by rotating the plurality of the blades around the rotation axis. For instance, a Sirocco fan is a centrifugal fan.

Since the centrifugal fan discharges air in the direction tangential to the rotation, discharged air pressure is large for a low rotational speed, compared with the axial fan. With the above inventions implemented, the whirring sound level may be lowered, and the low-noise characteristic of the centrifugal fan may be enhanced.

With one of the axial fan and the centrifugal fan discussed above incorporated in a personal computer or a projector, sound noise involved in the rotation of the fan during use is lowered in level, and low-noise electronic equipment thus results.

DETAILED DESCRIPTION OF PREFERRED EMBODIMENTS

Figure 1:
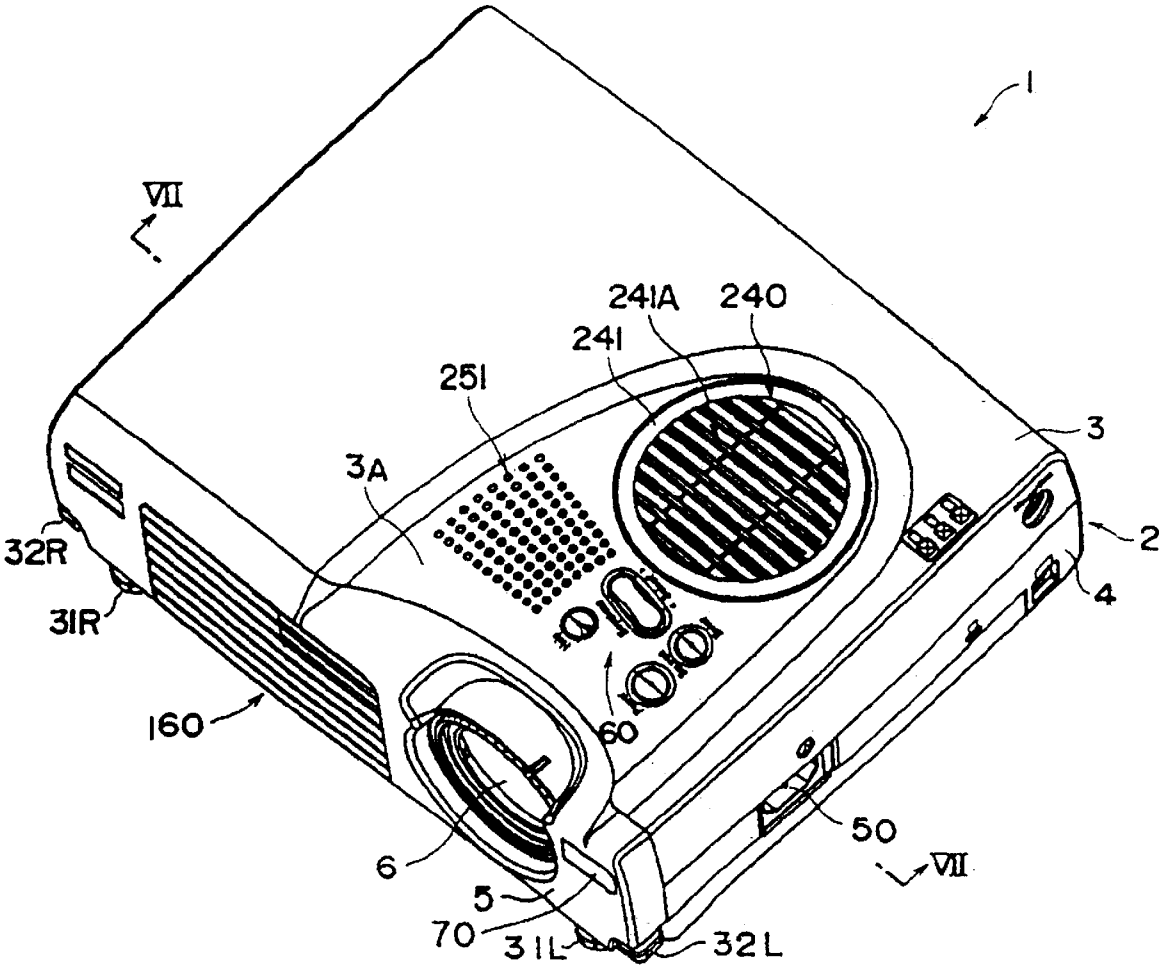
FIG. 1 is an external perspective view of a projector of an exemplary embodiment of the present invention, viewed from above.

One exemplary embodiment of the present invention is now discussed, referring to the drawings.

(1) General Construction of the Fan Device

Figure 2:
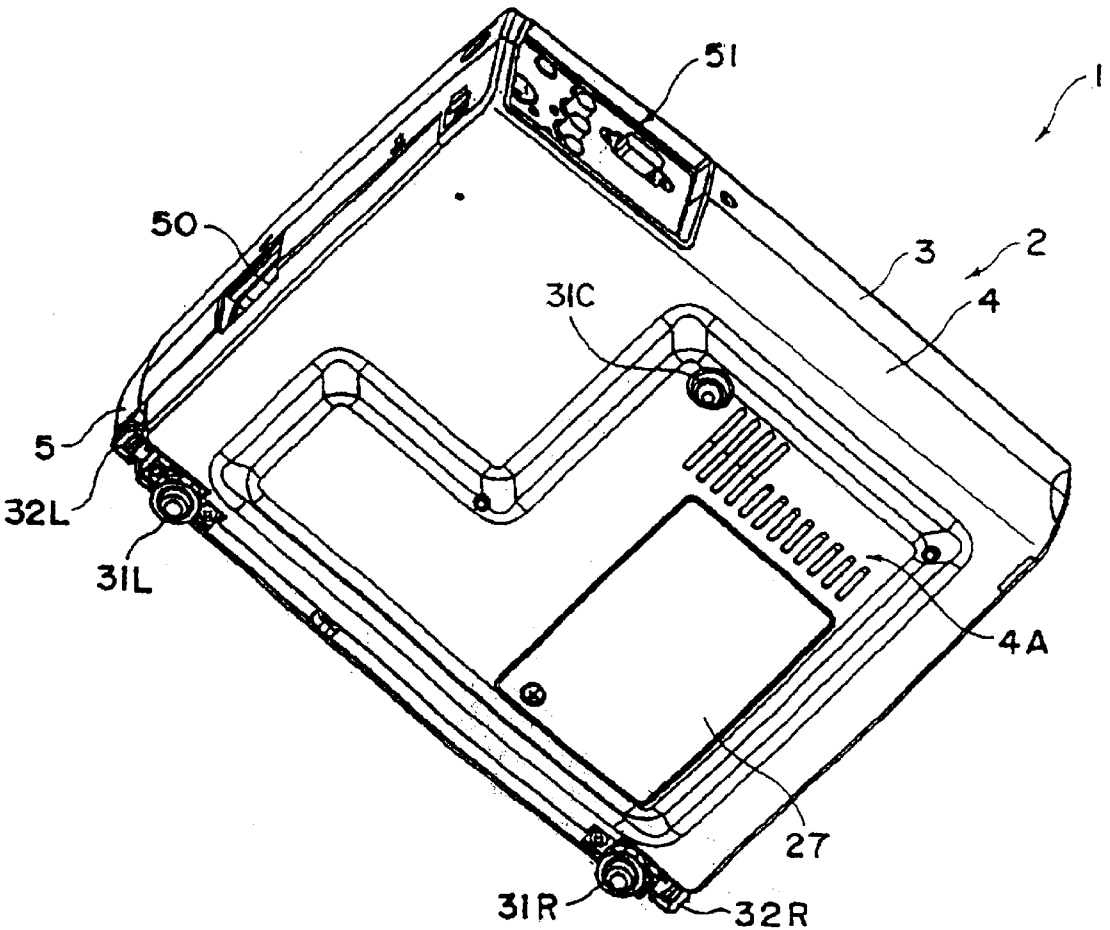
FIG. 2 is an external perspective view of the projector of FIG. 1, viewed from below.

FIG. 1 and FIG. 2 are diagrammatic perspective views of a projector 1 of a first exemplary embodiment, FIG. 1 is the perspective view looking toward the projector 1 from above, and FIG. 2 is the perspective view looking toward the projector 1 from below.

The projector 1 separates a light beam emitted from a light source device as a light source into the three primary color lights of red (R), green (G), and blue (B), modulates the respective color light beams through liquid-crystal display panels as an electro-optical device in response to video information, synthesizes the modulated color light beams through a cross-dichroic prism (a color synthesizing system) into a color image, and enlarges and projects the image onto a projection screen through a projection lens 6. The components are housed in an outer casing 2, and the projection lens 6 is projected out of the outer casing 2 by a zoom mechanism as necessary.

(2) Construction of the Outer Casing

The outer casing 2 basically includes an upper case 3 for covering the top of the projector 1, a lower case 4 for forming the bottom portion of the projector 1, and a front case 5 for covering the front of the projector 1. The upper case 3 and the lower case 4 are fabricated of magnesium die-casting, and the front case 5 is fabricated of resin.

An air intake port 240, associated with a resin filter exchange cover 241, is arranged on the top left surface (on the right-hand side, viewed from the front) of the upper case 3. The filter exchange cover 241 has slits 241A for taking in air from outside as cooling air into the projector 1. The filter exchange cover 241 is loaded with an air filter 242 (see FIG. 8) on the inner side thereof. By detaching and attaching the filter exchange cover 241 from and to the upper case 3, the air filter 242 inside is replaced.

Figure 7:
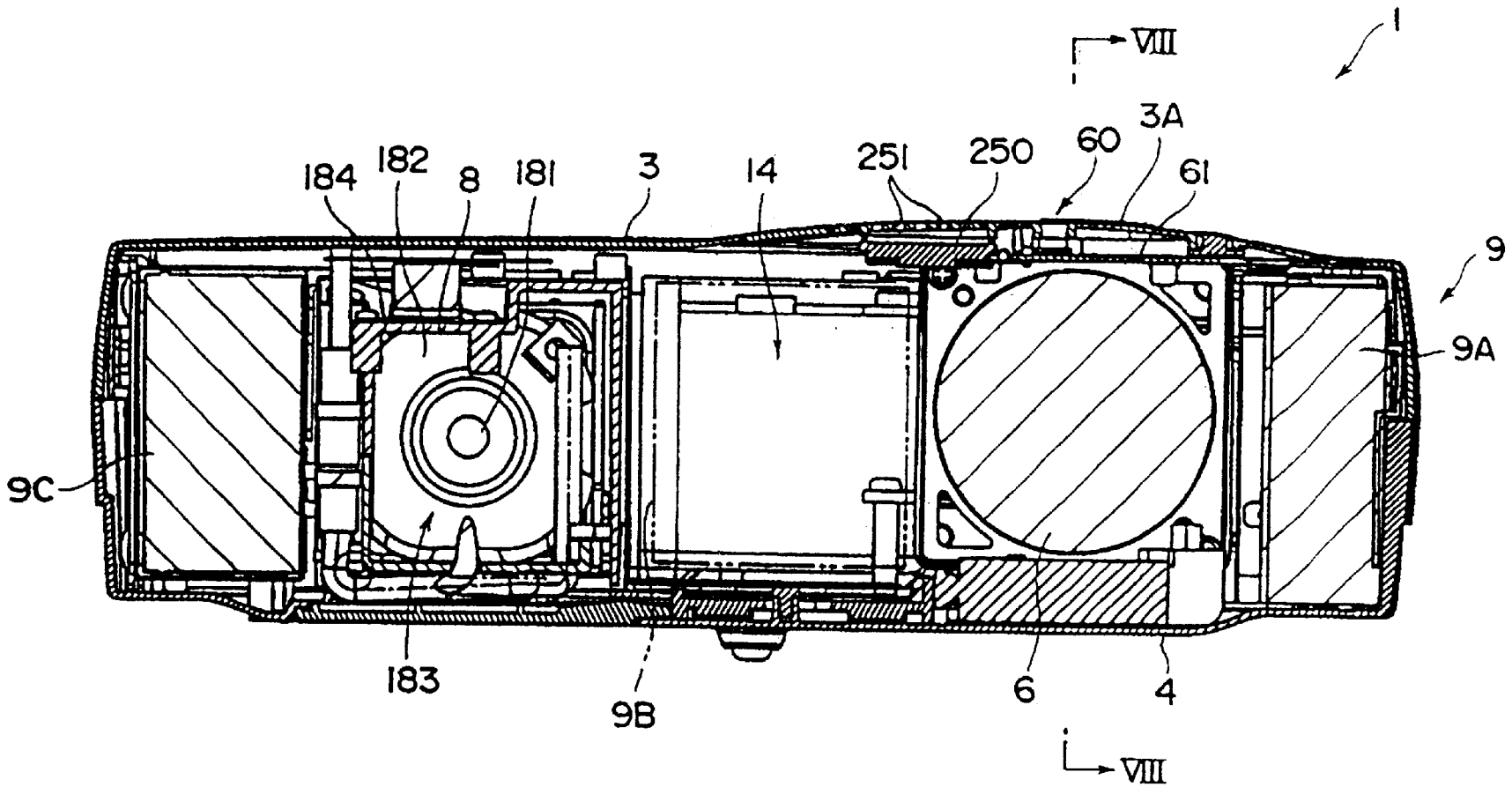
FIG. 7 is an elevational sectional view of the projector, taken along line VII–VII' in FIG. 1.
Figure 8:
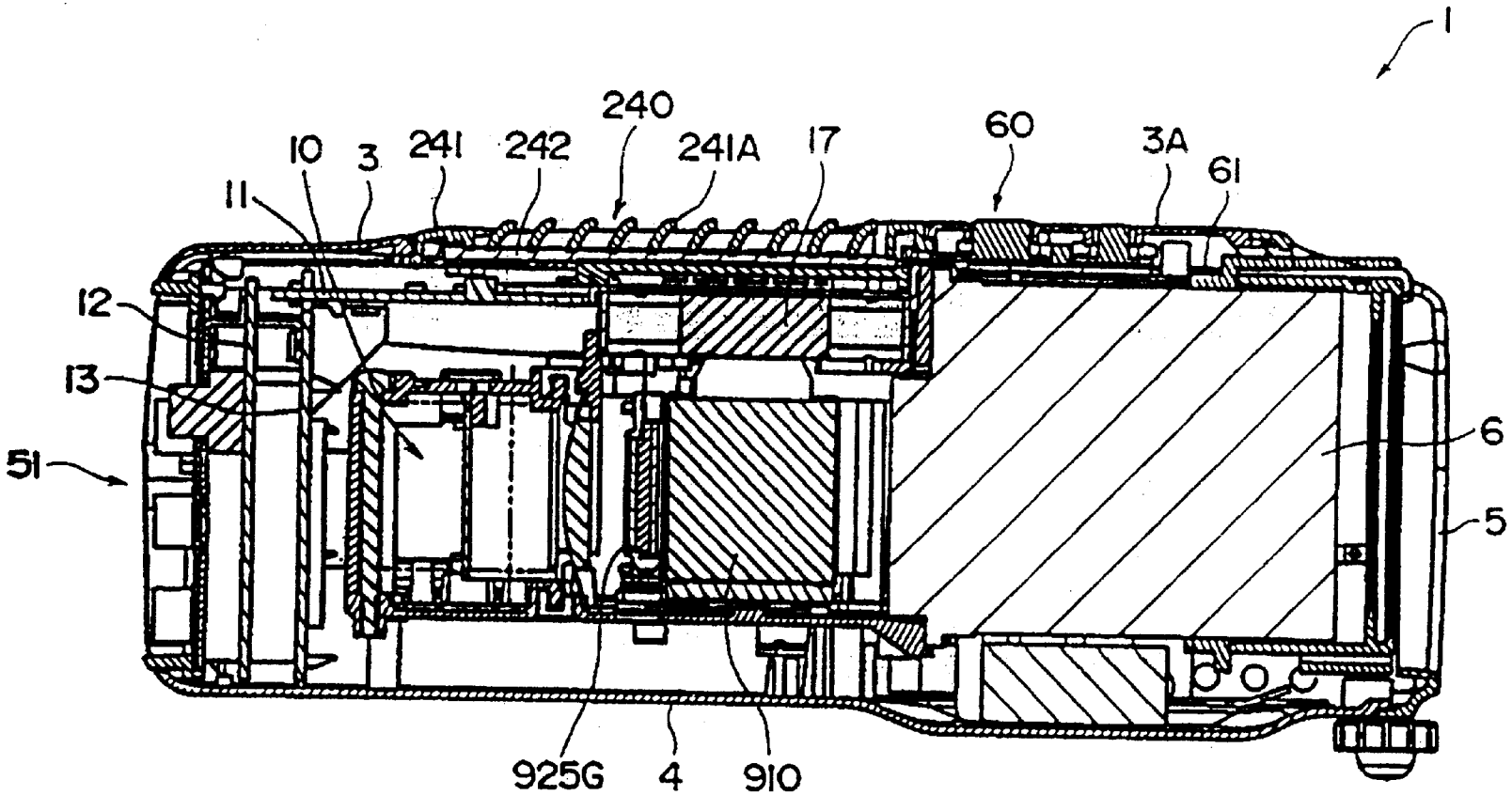
FIG. 8 is an elevational sectional view of the projector, taken along line VIII–VIII' in FIG. 7.

A number of communication holes 251 for a loudspeaker 250 (see FIG. 7) are drilled in front of the filter exchange cover 241 on the forward section of the top surface of the upper case 3. Arranged beside the holes 251 is an operation panel 60 for adjusting image quality of the projector 1. As shown in FIG. 7 and FIG. 8, the filter exchange cover 241, the communication holes 251, and the operation panel 60 are arranged in an extended portion 3A where the upper case 3 is partly upwardly extended. The internal space of the extended portion 3A partly serves as the spacing for accommodating the air filter 242, the loudspeaker 250, and a circuit board 61 for the operation panel 60.

As shown in FIG. 2, a lamp exchange lid 27, which is opened to replace a light source lamp unit 8 mounted inside (see FIG. 3 and FIG. 4), is arranged on the bottom surface of the lower case 4. Feet 31R and 31L are attached to the front corners on the bottom surface of the lower case 4, and a foot 31C is attached to the front center on the bottom surface of the lower case 4. The feet 31R and 31L are adjusted for projection or recession in the longitudinal direction thereof by turning the dial portion thereof or by operating levers 32R and 32L. The height and inclination of a projected image are thus adjusted.

A light receiving section 70 for receiving a light signal from an unshown remote controller is arranged on the right-hand side of the front case 5. An air-exhaust port 160 for discharging air from within the projector 1 is formed in the generally central portion of the front case 5.

Arranged on the back side of the outer casing 2 near the air intake port 240 are an AC inlet 50 for connection with an external power source and a terminal bank 51 having a variety of input/output terminals.

(3) Internal Construction of the Projector

Figure 3:
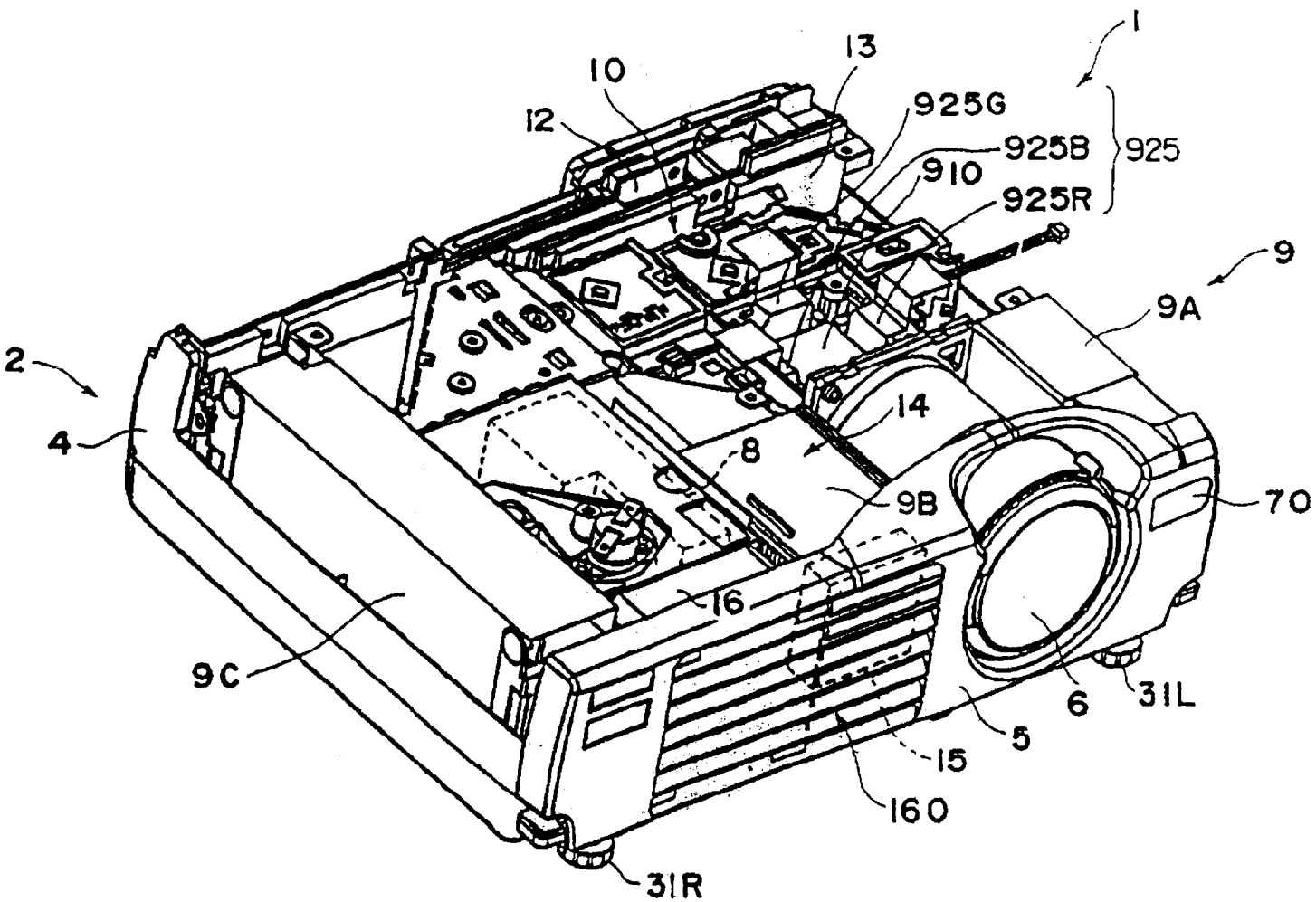
FIG. 3 is a perspective view showing the internal construction of the projector of FIG. 1.
Figure 4:
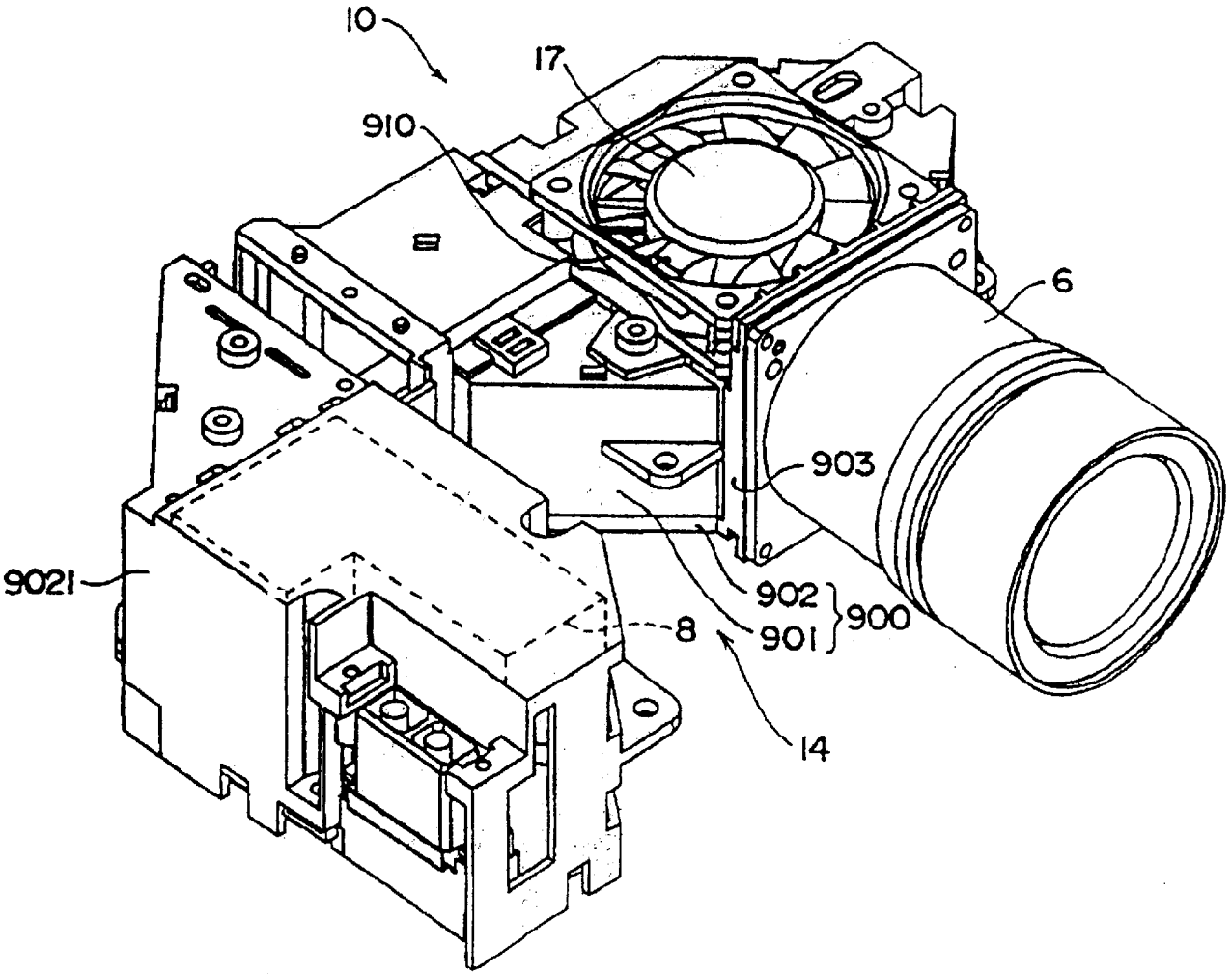
FIG. 4 is a perspective view showing an optical system of the projector of FIG. 1.
Figure 5:
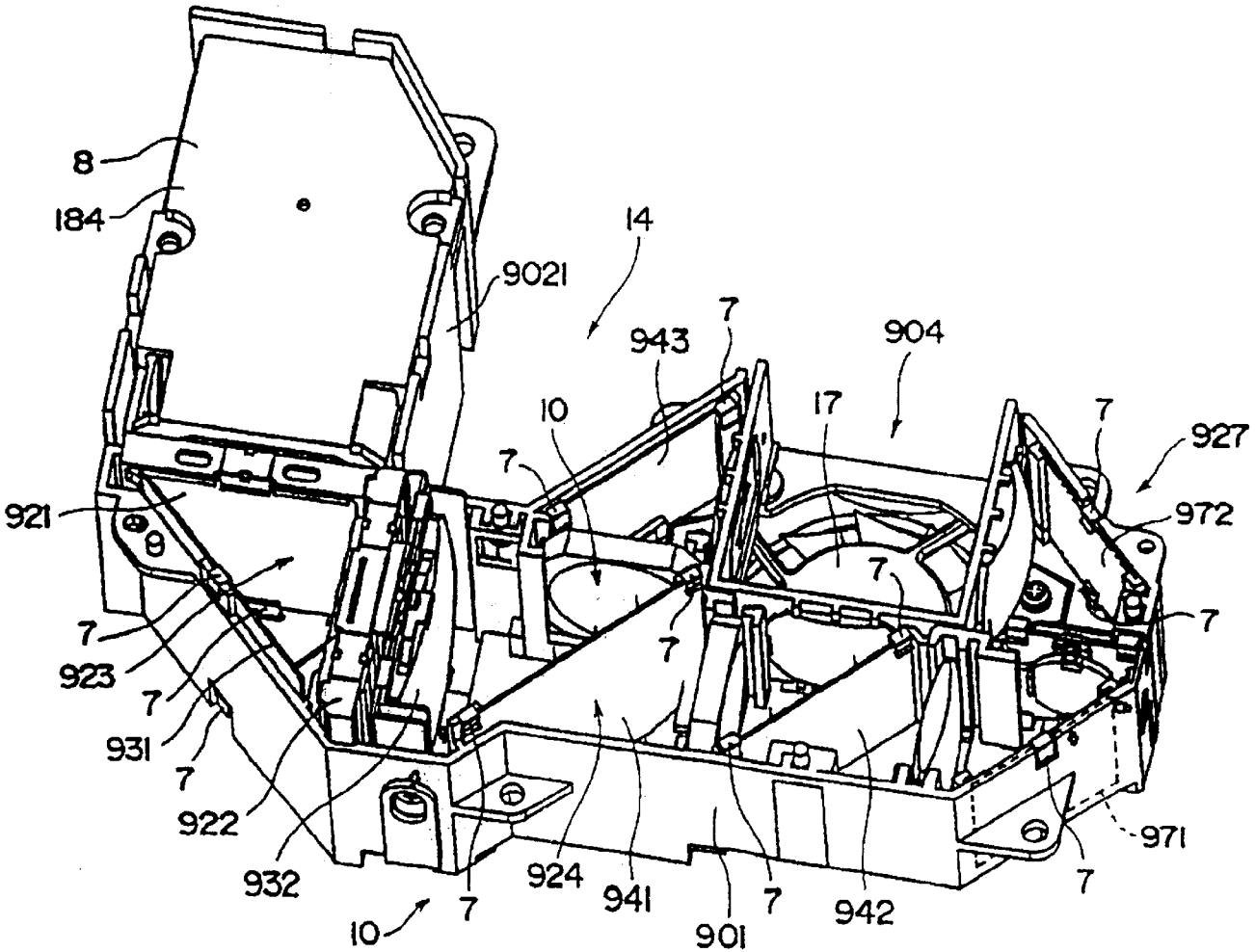
FIG. 5 is a perspective view showing the construction of the optical system of FIG. 4.
Figure 6:
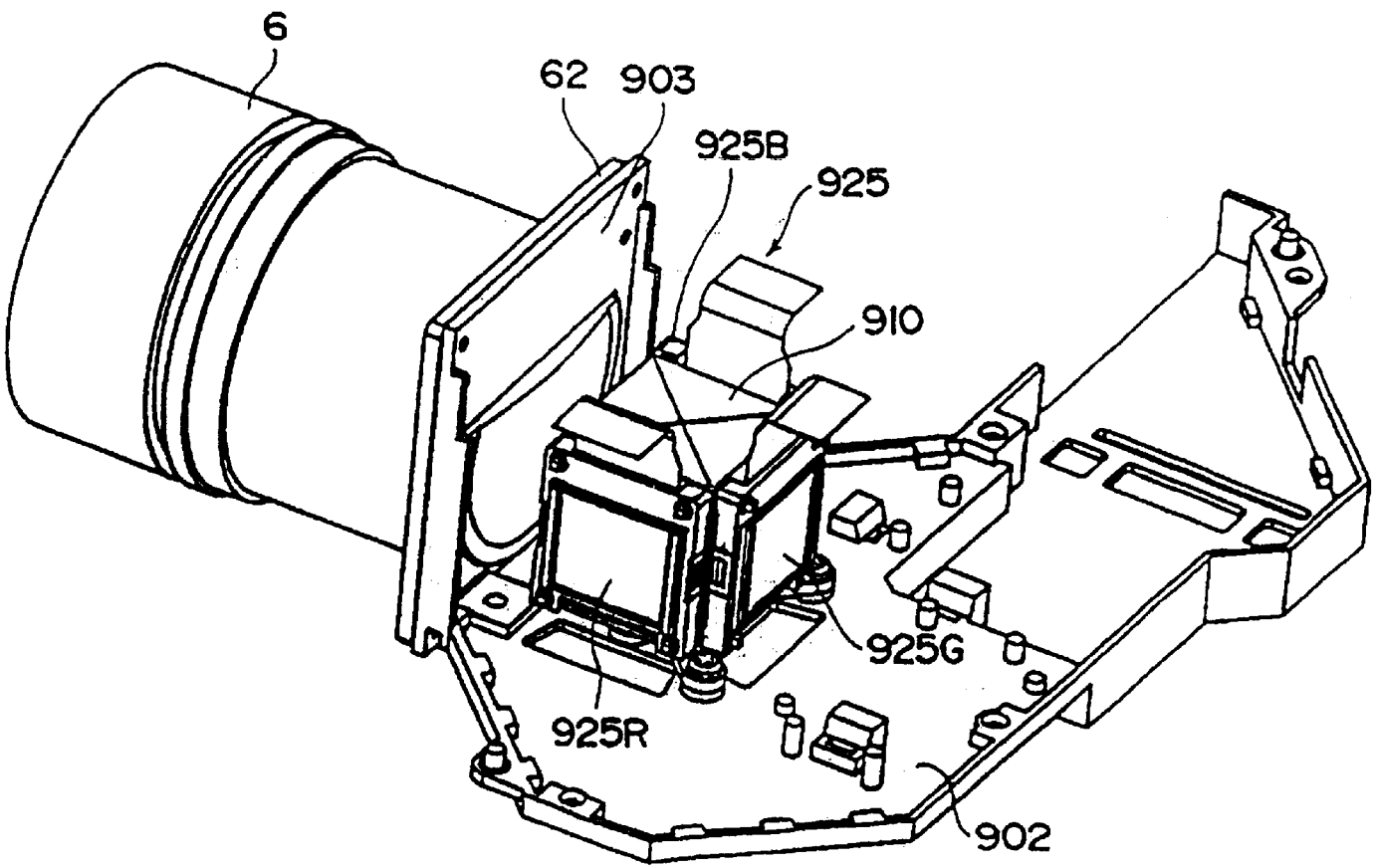
FIG. 6 is another perspective view showing the construction of the optical system of FIG. 4.

FIG. 3–FIG. 8 show the internal construction of the projector 1. FIG. 3 is a diagrammatic perspective view showing the internal construction of the projector 1, FIG. 4 is a perspective view showing an optical system of the projector 1, FIG. 5 and FIG. 6 are perspective views showing the internal construction of the optical system of the projector 1, and FIG. 7 and FIG. 8 are elevational sectional views of the projector 1.

Figure 9:
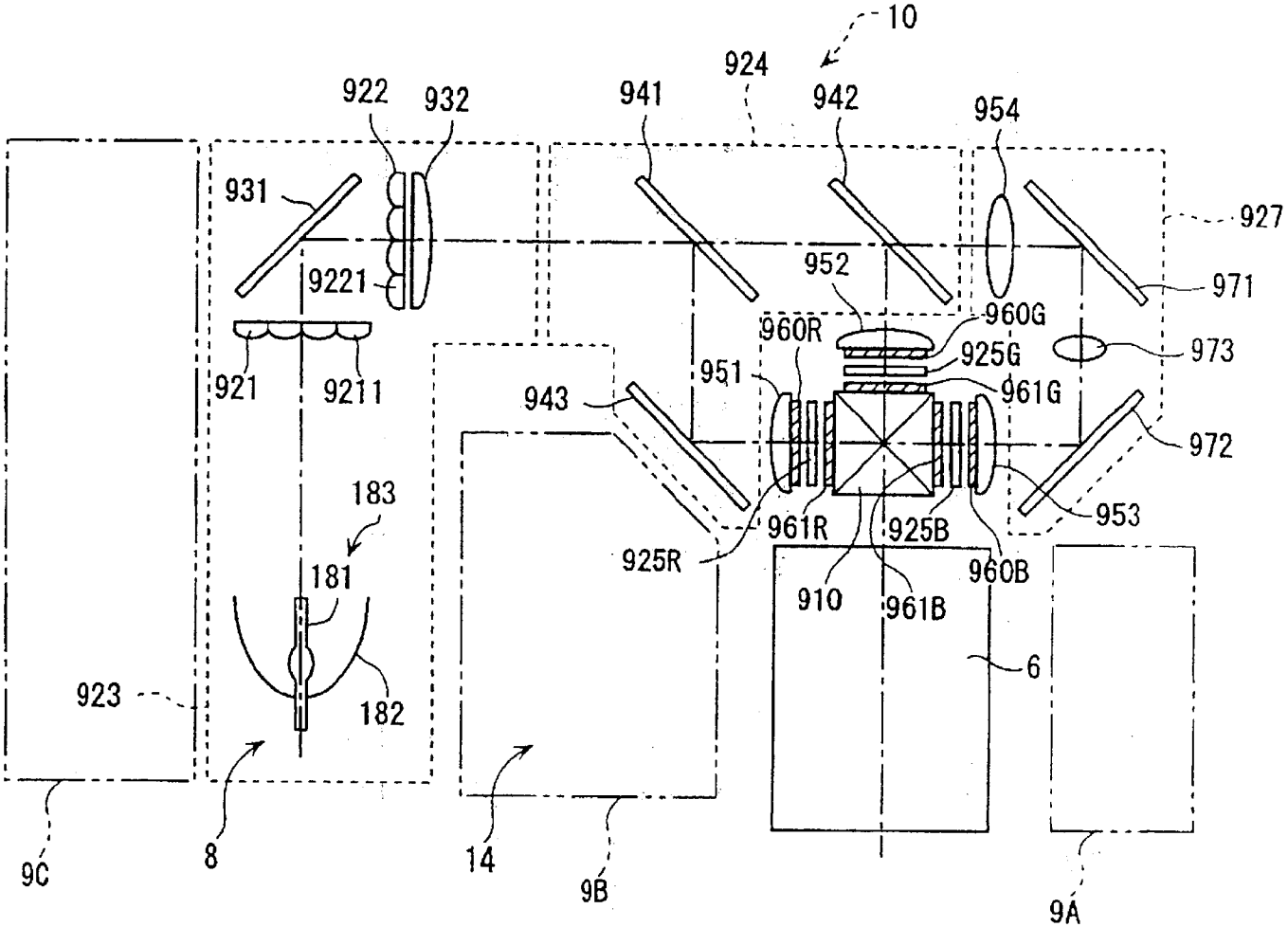
FIG. 9 is a diagrammatic view showing the function of the optical system of FIG. 4.

As shown, the outer casing 2 houses the light source lamp unit 8, a power source unit 9 as a power source, an optical unit 10, a driver board 11 (see FIG. 8), a main board 12, and an AV board 13. As shown in FIG. 9, in this exemplary embodiment, the light source lamp unit 8, the optical unit 10, and the already-discussed projection lens 6 form an optical system having a letter-U-shaped configuration in a plan view, and a control system is composed of the boards 11, 12, and 13.

The power source unit 9 is composed of a first power source block 9A arranged beside the projection lens 6 of the optical system, a second power source block 9B arranged in a central opening 14 in the letter-U-shaped configuration optical system, namely, between the projection lens 6 and the light source lamp unit 8, and a third power source block 9C arranged beside the light source lamp unit 8 of the optical system.

The first power source block 9A includes the AC inlet 50, and distributes power supplied through the AC inlet 50 from the external power source, to the second power source block 9B and the third power source block 9C.

The second power source block 9B transforms the voltage supplied from the first power source block 9A, and then feeds the transformed voltages to the main board 12 that constitutes the control system. Attached to the air-exhaust port 160 of the second power source block 9B is an auxiliary air-exhaust fan 15 driven by power supplied from the second power source block 9B.

The third power source block 9C transforms the voltage supplied by the first power source block 9A, and feeds the transformed voltage to a light source device 183 (see FIG. 9) as a light source in the light source lamp unit 8. Specifically, since the third power source block 9C needs to supply power to the light source device 183, which consumes power most, the third power source block 9C, coextending within the projector 1 from the front to the back thereof, is larger than the first and second power source blocks 9A and 9B.

The first through third power source blocks 9A, 9B, and 9C are secured to the lower case 4 with screws, prior to the installation of the projection lens 6 and the optical unit 10. Alternatively, the first power source block 9A may supply power to the second power source block 9B only, and the third power source block 9C may be supplied with power by the second power source block 9B.

The light source lamp unit 8 constitutes a light source section of the projector 1. As shown in FIG. 7 and FIG. 9, the light source lamp unit 8 includes the light source device 183, composed of a light-source lamp 181 and a concave mirror 182, and a lamp housing 184 holding the light source device 183.

As shown in FIG. 4, in the lamp housing 184, the light source lamp unit 8 as the light source device is covered with a container 9021 that is integrally formed with an upper light guide 901, constituting a light guide 900 to be discussed later. As already discussed, the light source lamp unit 8 is dismounted by opening the lamp exchange lid 27. A main air-exhaust fan 16, larger than the auxiliary air-exhaust fan 15, is installed in a position corresponding to the air-exhaust port 160 in front of the container 9021. The main air-exhaust fan 16 is also driven by the second power source block 9B.

The optical unit 10 forms an optical image corresponding to video information, by optically processing the light beam emitted by the light source lamp unit 8, and includes the light guide 900. The light guide 900 is composed of the box-like upper light guide 901, fabricated of resin, and a lid-like lower light guide 902, fabricated of magnesium. The light guide 900 houses an illumination optical system 923, a color separating optical system 924, an electro-optical device 925 as a modulator system, and a cross-dichroic prism 910 as a color synthesizing optical system. A vertically aligned head plate 903, to which the projection lens 6 is affixed, is attached to the lower light guide 902. The optical elements of the optical unit 10, other than the electro-optical device 925 and the cross-dichroic prism 910, are clamped and held between the upper and lower light guides 901 and 902. The upper light guide 901 and the lower light guide 902 are joined together, and are secured to the lower case 4.

The cross-dichroic prism 910 is arranged behind the head plate 903, and is secured to the lower light guide 902. Liquid-crystal display panels 925R, 925G, and 925B, forming the electro-optical device 925, are arranged to face three sides of the cross-dichroic prism 910, and are bonded to the respectively sides of the cross-dichroic prism 910 with a fixing member interposed therebetween. As for the positional relationship of the liquid-crystal display panels 925R, 925G, and 925B, the liquid-crystal display panel 925B and the liquid-crystal display panel 925R are opposed to each other with the cross-dichroic prism 910 interposed therebetween, and the liquid-crystal display panel 925G and the projection lens 6 are opposed to each other with the cross-dichroic prism 910 interposed therebetween. The liquid-crystal display panels 925R, 925G, and 925B are cooled by cooling air supplied by an air-intake fan 17 which is mounted over the cross-dichroic prism 910 in a position facing the air intake port 240. The driving the air-intake fan 17 is supplied with power by the main board 12 via the driver board 11.

The driver board 11 controls the liquid-crystal display panels 925R, 925G, and 925B of the above-referenced electro-optical device 925, and is mounted above the optical unit 10.

The main board 12 includes a control circuit for generally controlling the entire projector 1, and is arranged behind the optical unit 10. The main board 12 and the driver board 11 are arranged to be mutually perpendicular to each other, and are mutually electrically connected to each other with connectors.

The AV board 13 is a circuit board having the terminal bank 51 thereon. The AV board 13 is erected between the optical unit 10 and the main board 12, and is electrically connected to the main board 12.

In the above internal construction, cooling air taken in by the air-intake fan 17 cools the electro-optical device 925, and is then guided while cooling the boards 11, 12, and 13 as the air-exhaust fans 15 and 16 rotate, and travels toward the light source lamp unit 8. Along with new cooling air taken in through an intake port 4A (see FIG. 2) arranged in the bottom surface of the lower case 4, the cooling air mainly flows into the light source lamp unit 8, thereby cooling the light source device 183. A portion of the cooling air flows beside the second power source block 9B, thereby cooling it. Another portion of the cooling air flows beside the third power source block 9C, thereby cooling it. The cooling air is then frontwardly discharged out of the projector 1 through the air-exhaust port 160 by the air-exhaust fans 15 and 16.

(4) Construction of the Optical System

Referring to FIG. 5 and FIG. 9, the optical unit 10 of the optical system is now discussed in detail.

The optical unit 10 is composed of the illumination optical system 923, the color separating optical system 924, and a relay optical system 927 respectively housed in the upper light guide 901, and the electro-optical device 925, and the cross-dichroic prism 910 as the color synthesizing optical system respectively secured to the lower light guide 902, and the projection lens 6 secured to the head plate 903 of the lower light guide 902.

The illumination optical system 923 is an integrator illumination optical system for substantially uniformly illuminating the image forming regions of the three liquid-crystal display panels 925R, 925G, and 925B of the electro-optical device 925. The illumination optical system 923 includes the light source device 183, a first lens array 921, a second lens array 922, a reflective mirror 931, and a superimposing lens 932. The lens arrays 921 and 922, the superimposing lens 932, and the reflective mirror 931 are supported by vertical portions of the upper light guide 901 and are secured by clips 7 as fastening members. Even if the upper light guide 901 is placed upside down from the stage shown in FIG. 5, these components remain fastened.

The light source device 183, forming the illumination optical system 923, includes the light-source lamp 181 serving as an illumination light source for emitting a light beam, and the concave mirror 182 that collimates the light beam emitted from the light-source lamp 181 into a substantially parallel light beam. The light-source lamp 181 is typically a halogen lamp, a metal halide lamp, or a high-pressure mercury lamp. The concave mirror 182 preferably has a parabolic surface or an ellipsoidal surface.

The first lens array 921 has a matrix of M rows by N columns of small lenses 9211, each having a rectangular shape. The small lenses 9211 split the collimated light beam from the light source into a plurality of collimated partial beams (i.e., M×N partial beams), and focuses these partial beams in the vicinity of the second lens array 922. The outline of each small lens 9211 is substantially analogous in shape to the image forming region of each of the liquid-crystal display panels 925R, 925G, and 925B. For instance, if the aspect ratio (the ratio of the horizontal width to the vertical height) of the liquid-crystal display panel is 4:3, the aspect ratio of the small lens is also set to be 4:3.

The second lens array 922 has a matrix of M rows by N columns of small lenses 9221, correspondingly to the micro lenses 9211 of the first lens array 921. The second lens array 922 has the function of aligning the central axis of each partial beam (principal beam) so that the central axis is incident on the incident surface of the superimposing lens 932 at a right angle thereto. The superimposing lens 932 has the function of superimposing the plurality of the partial beams on each of the three liquid-crystal display panels 925R, 925G, and 925B. With reference to FIG. 5, the reflective mirror 931 extends along the right angle made between the first lens array 921 and the second lens array 922.

The reflective mirror 931 guides the partial beams from the first lens array 921 to the second lens array 922, and may be dispensed with, depending on the construction of the illumination optical system in use. For instance, if the first lens array 921 is arranged in parallel with the second lens array 922, the reflective mirror 931 is not needed.

The color separating optical system 924 includes two dichroic mirrors 941 and 942 as optical components of the present invention, and a reflective mirror 943, and has the function of separating light from the superimposing lens 932 of the illumination optical system 923 into the three color light beams of red, green, and blue. In a way similar to the one described above, the mirrors 941, 942, and 943 are supported by vertically aligned portions of the upper light guide 901 and secured by the clips 7 to the upper light guide 901.

The relay optical system 927 includes an entrance lens 954, a relay lens 973, and reflective mirrors 971 and 972. The reflective mirrors 971 and 972 are also secured to the upper light guide 901 by clips 7.

The three liquid-crystal display panels 925R, 925G, and 925B of the electro-optical device 925 are of a type employing polysilicon TFTs as switching devices. The three liquid-crystal display panels 925R, 925G, and 925B are arranged within the internal spacing 904 (see FIG. 5) surrounded by the upper light guide 901 so that these panels, facing the three sides of the cross-dichroic prism 910, are bonded to the respective sides of the cross-dichroic prism 910 with the fixing member interposed therebetween. Arranged on the light entrance sides of the liquid-crystal display panels 925R, 925G, and 925B are respectively entrance polarizers 960R, 960G, and 960B. Arranged on the light exit sides of the liquid-crystal display panels 925R, 925G, and 925B are respectively exit polarizers 961R, 961G, and 961B.

The cross-dichroic prism 910 has the function of forming a color image by synthesizing the three color light beams, and is secured to the top surface of the lower light guide 902 by screws. The cross-dichroic prism 910 is constructed by gluing four right-angle prisms with a dielectric multilayered film reflecting the red light and a dielectric multilayered film reflecting the blue light interposed in a cross configuration in the interfaces between the right-angle prisms. These dielectric multilayered films synthesize the three color light beams.

The projection lens 6 is the heaviest optical component in the projector 1, and is secured to the head plate 903 of the lower light guide 902 with a flange 62 (FIG. 6) of the support end thereof fixed to the head plate 903, using screws.

The above optical unit 10 is assembled in the following procedure.

The box-like upper light guide 901 is placed with the opening thereof facing upward. The optical components (such as reflective mirrors and lenses), forming the illumination optical system 923, the color separating optical system 924, and the relay optical system 927 are arranged, and secured to the upper light guide 901 with the clips 7.

The cross-dichroic prism 910, with the liquid-crystal display panels 925R, 925G, and 925B affixed thereto, is mounted on the top surface of the lid-like lower light guide 902, and the projection lens 6 is secured to the head plate 903. The upper light guide 901 having the optical components mounted thereon is inverted in position, and is mounted onto the lower light guide 902 to cover it, and is fixed.

The light guide 900 thus assembled is fastened to the lower case 4 with screws.

Alternatively, the lower light guide 902, with the liquid-crystal display panels 925R, 925G, and 925B, the cross-dichroic prism 910, and the projection lens 6 installed thereon, may be beforehand fixed to the lower case 4, the upper light guide 901 having the optical components mounted thereon may be inverted in position, and mounted to the lower light guide 902 to cover it, and the upper light guide 901 may be then secured to the lower case 4 with screws.

Alternatively, the lower light guide 902 only may be beforehand secured to the lower case 4, the liquid-crystal display panels 925R, 925G, and 925B, the cross-dichroic prism 910, and the projection lens 6 may be then installed thereon, and the upper light guide 901 having the optical components mounted thereon may be inverted in position, and mounted to the lower light guide 902 to cover it, and the upper light guide 901 may be then secured to the lower case 4 with screws.

In this exemplary embodiment, the securing of the cross-dichroic prism 910 and the projection lens 6 to the lower light guide 902 and the securing of the upper light guide 901 and the lower light guide 902 to the lower case 4 are performed using screws. Alternatively, the securing may be performed using an adhesive, or fit, or any other fixing technique.

(5) Functions of the Optical System

In the optical unit 10 shown in FIG. 9, the substantially collimated beam from the light source device 183 is split into the plurality of the partial beams through the first and second lens arrays 921 and 922 forming the integrator optical system (the illumination optical system 923). The partial beams from the small lenses 9211 of the first lens array 921 are superimposed by the superimposing lens 932 onto the image forming region of each of the liquid-crystal display panels 925R, 925G, and 925B. As a result, the liquid-crystal display panels 925R, 925G, and 925B are illuminated by illumination light having uniform distribution within the screen thereof.

The first dichroic mirror 941 of the color separating optical system 924 reflects the red color component of the light beam emitted from the illumination optical system 923 while transmitting the blue color component and the green color component of the light beam therethrough. The red color light reflected from the first dichroic mirror 941 is then reflected from the reflective mirror 943, and is transmitted through a field lens 951, and reaches the red-color liquid-crystal display panel 925R. The field lens 951 collimates each partial beam from the second lens array 922 to be parallel with the central axis (principal beam) of the partial beam. Field lens 952 and 953 respectively arranged on the remaining liquid-crystal display panels 925G and 925B work in a similar manner.

The green light, out of the green light and the blue light, transmitted through the first dichroic mirror 941, is reflected from the second dichroic mirror 942, is then transmitted through the field lens 952, and reaches the green-color liquid-crystal display panel 925G. The blue light is transmitted through the second dichroic mirror 942, the relay optical system 927, the field lens 953, and reaches the blue-color liquid-crystal display panel 925B. Since the optical path of the blue color light is longer than those of the other color light rays, the relay optical system 927 is used for the blue color optical path. The relay optical system 927 thus avoids a drop in the utilization of light arising from light diffusion or the like. Specifically, the relay optical system 927 transmits the partial beams incident on the entrance lens 954 directly to the field lens 953 with no loss involved.

The red, green, and blue color light beams are respectively polarized through the entrance polarizers 960R, 960G, and 960B prior to the entrance to the liquid-crystal display panels 925R, 925G, and 925B. The respective polarized light beams are modulated by the liquid-crystal display panels 925R, 925G, and 925B in accordance with video information, and then the modulated light beams respectively travel to the exit polarizers 961R, 961G, and 961B. The exit polarizers 961R, 961G, and 961B permit respective polarized light of the modulated light beams to transmit therethrough, and to reach the cross-dichroic prism 910. The polarized light beams output are synthesized through the cross-dichroic prism 910 as a synthesized light beam, and is then directed to the projection lens 6. The synthesized light beam is projected onto a projection screen as a color image by the projection lens 6.

(6) Construction of the Exhaust Fan and the Intake Fan

Figure 10:
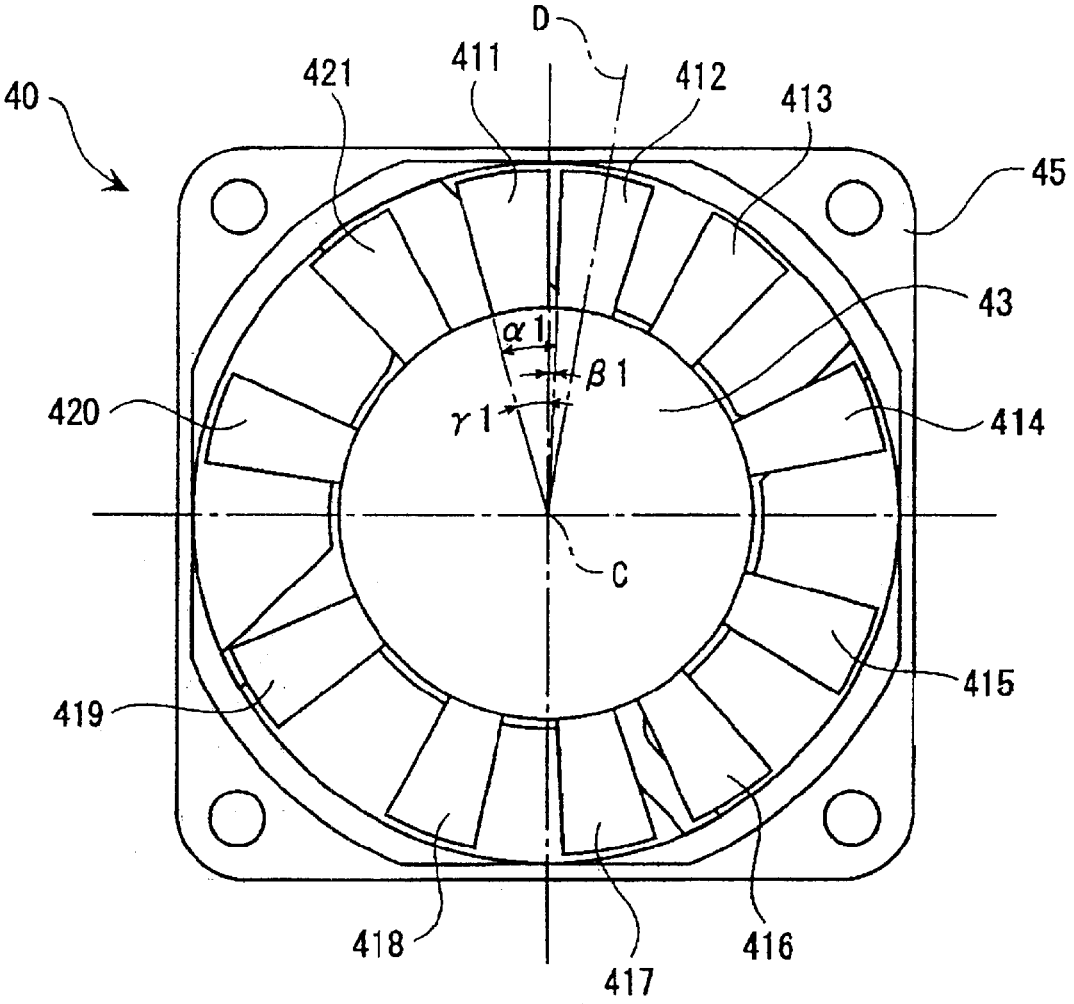
FIG. 10 is a plan view showing the construction of an axial fan such as an exhaust fan or air intake fan in the above exemplary embodiment.

Each of the main air-exhaust fan 16 and the air-intake fan 17, arranged in the projector 1 thus constructed, employs an axial fan 40 as shown in FIG. 10. The axial fan 40 includes a plurality of blades 411–421 arranged around a rotation axis C, a blade support member 43 rotatably supported about the rotation axis C for supporting the plurality of the blades 411–421 at the base portions thereof, and a casing 45 housing the plurality of the blades 411–421. Though not shown, a drive motor for driving the plurality of the blades 411–421 of the axial fan 40 is installed behind the blade support member 43. The blade support member 43 is rigidly attached to the rotary shaft of the drive motor. When the drive motor rotates, the blade support member 43 also rotates, and the plurality of the blades 411–421 rotate about the rotation axis C, thereby causing air to flow.

The axial fan 40 includes the eleven blades 411–421. All blades 411–421 are not arranged at an equal pitch about the rotation axis C, and some of the blades 411–421 are arranged at a pitch different from that of the remaining blades. The eleven blades 411–421 are thus arranged at varied pitches.

As for the actual layout pitches in this embodiment, as shown in FIG. 10, $\alpha 1$ (degrees) represent a pitch angle between the blade 411 and the blade 412, $\beta 1$ (degrees) represents an angle spacing between the blade 411 and the blade 412, and $\gamma 1$ (degrees) represents a blade angle width of the blade 411 with respect to the blade support member 43. With respect to the blade 411 as a reference, layout pitch angles $\alpha 1$–$\alpha 11$, angle spacing $\beta 1$–$\beta 11$, and angle widths $\gamma 1$–$\gamma 11$ are set up around the rotation axis C. By setting these parameters to desired values, the varied pitch is attained in the axial fan 40. For instance, by setting the angle widths $\gamma 1$–$\gamma 11$ of the blades 411–421 to a constant value of $\gamma$=15.7°, the layout pitch angles $\alpha 1$–$\alpha 11$, and the angle spacings $\gamma 1$–$\gamma 11$ may be set as listed in Table 1.

TABLE 1

| BLADE NO. | PITCH ANGLE $\alpha$ | ANGLE SPACING $\beta$ | BLADE ANGLE WIDTH $\gamma$ |
|---|---|---|---|
| 411 | $\alpha 1$ = 17.7° | $\beta 1$ = 2° | $\gamma 1$ = 15.7° |
| 412 | $\alpha 2$ = 26.7° | $\beta 2$ = 11° | $\gamma 2$ = 15.7° |
| 413 | $\alpha 3$ = 34.7° | $\beta 3$ = 19° | $\gamma 3$ = 15.7° |
| 414 | $\alpha 4$ = 42.7° | $\beta 4$ = 27° | $\gamma 4$ = 15.7° |
| 415 | $\alpha 5$ = 32.7° | $\beta 5$ = 17° | $\gamma 5$ = 15.7° |
| 416 | $\alpha 6$ = 22.7° | $\beta 6$ = 7° | $\gamma 6$ = 15.7° |
| 417 | $\alpha 7$ = 30.7° | $\beta 7$ = 15° | $\gamma 7$ = 15.7° |
| 418 | $\alpha 8$ = 38.7° | $\beta 8$ = 23° | $\gamma 8$ = 15.7° |
| 419 | $\alpha 9$ = 47.7° | $\beta 9$ = 32° | $\gamma 9$ = 15.7° |
| 420 | $\alpha 10$ = 37.7° | $\beta 10$ = 22° | $\gamma 10$ = 15.7° |
| 421 | $\alpha 11$ = 27.7° | $\beta 11$ = 12° | $\gamma 11$ = 15.7° |

In the layout pitch angles $\alpha 1$–$\alpha 11$ of the blades of the axial fan 40 listed in Table 1, the layout pitch angle $\alpha 1$ between the blade 411 and the blade 412 is set to be substantially equal to the layout pitch angle $\alpha 6$ between the blade 416 and the blade 417, which are diametrically opposed to and symmetrically arranged with the blade 411 and the blade 412 with respect to the rotation axis C. The layout pitch angle $\alpha 1$ between the blade 411 and the blade 412 is set to be close to the layout pitch angle $\alpha 2$ between the adjacent blades 412 and 413, and the layout pitch angle $\alpha 11$ between the adjacent blade 421 and the blade 411.

The designing of the axial fan 40 with the blades 411–421 having varied pitch angles is based on the angle spacing $\beta$ between the adjacent blades.

1) First, the minimum angle the angle spacing $\beta$ can take is set. When the axial fan 40 is manufactured through injection molding, the angle spacing $\beta$ needs to be 2° or larger, because the blades are not separated from each other with an angle spacing $\beta$ smaller than 2°. The minimum angle spacing $\beta$ is thus set to be 2°.

2) If the eleven blades are equally spaced around the rotation axis C, the layout pitch of the blades are 360°/11 blades, i.e., 32.7°. If an average angle spacing is 17°, the maximum angle is 15°. The maximum angle spacing is thus set to be 32°.

3) If $\beta 1$ is set to the minimum angle spacing of 2° under the condition of $2° \leqq \beta \leqq 32°$, $\beta 2$ is set by increasing $\beta 1$ by 9°. The angle spacings $\beta 3$, . . . , are gradually stepwise increased. When $\beta$max reaches about 32°, $\beta$ is then determined by decreasing $\beta$max by 10°.

4) When $\beta 1$–$\beta 11$ are set, a fixed angle width $\gamma$=15.7° is added to each of $\beta 1$–$\beta 11$, thereby determining $\alpha 1$–$\alpha 11$.

(7) Advantages of the First Embodiment

The above first embodiment provides the following advantages.

1) Since the blades 411–421 are arranged around the rotation axis C at varied pitches, the whirring sound, which is high in level with the plurality of equally pitched blades, may be lowered. A low-nose axial fan 40 may thus result.

2) Since the axial fan 40 is employed for the main air-exhaust fan 16 and the air-intake fan 17 in the projector 1, noise arising from the rotation of the main air-exhaust fan 16 and the air-intake fan 17 may be reduced during the operation of the projector 1. A low-noise projector may thus result.

3) Referring to Table 1, the layout pitch angle $\alpha 1$ between the blade 411 and the blade 412 is set to be substantially equal to the layout pitch angle $\alpha 6$ between the blade 416 and the blade 417, which are diametrically opposed to and symmetrically arranged with the blade 411 and the blade 412 with respect to the rotation axis C, and thus the weight balance of the plurality of the blades 411–421 and the blade support member 43 is assured around the rotation axis C. This arrangement controls the generation of the clattering noise during rotation, and the eccentricity of the axial fan 40, thereby relieving a large load on the drive motor.

4) Since the number of the blades 411–421 of the axial fan 40 is set to be 11, no whirring sound attributed to any divisor takes place, unlike in the case where the whirring sound attributed to divisors 2, 3, and 4 takes place when 8 blades or 9 blades are used. The low-noise characteristic of the axial fan 40 is even more enhanced.

(8) Construction and Advantages of a Second Exemplary Embodiment

A second exemplary embodiment of the present invention is now discussed. In the following discussion, like components are designated with like reference numerals, and the discussion thereabout is omitted.

In the first exemplary embodiment, the axial fan 40 has a fixed blade angle width of 15.7° as the angle width $\gamma 1$–$\gamma 11$, and the plurality of the blades 411–421 having the same configuration are arranged at the varied pitches. The whirring sound involved in the rotation of the plurality of the blades 411–421 of the axial fan 40 is thus controlled.

Figure 11:
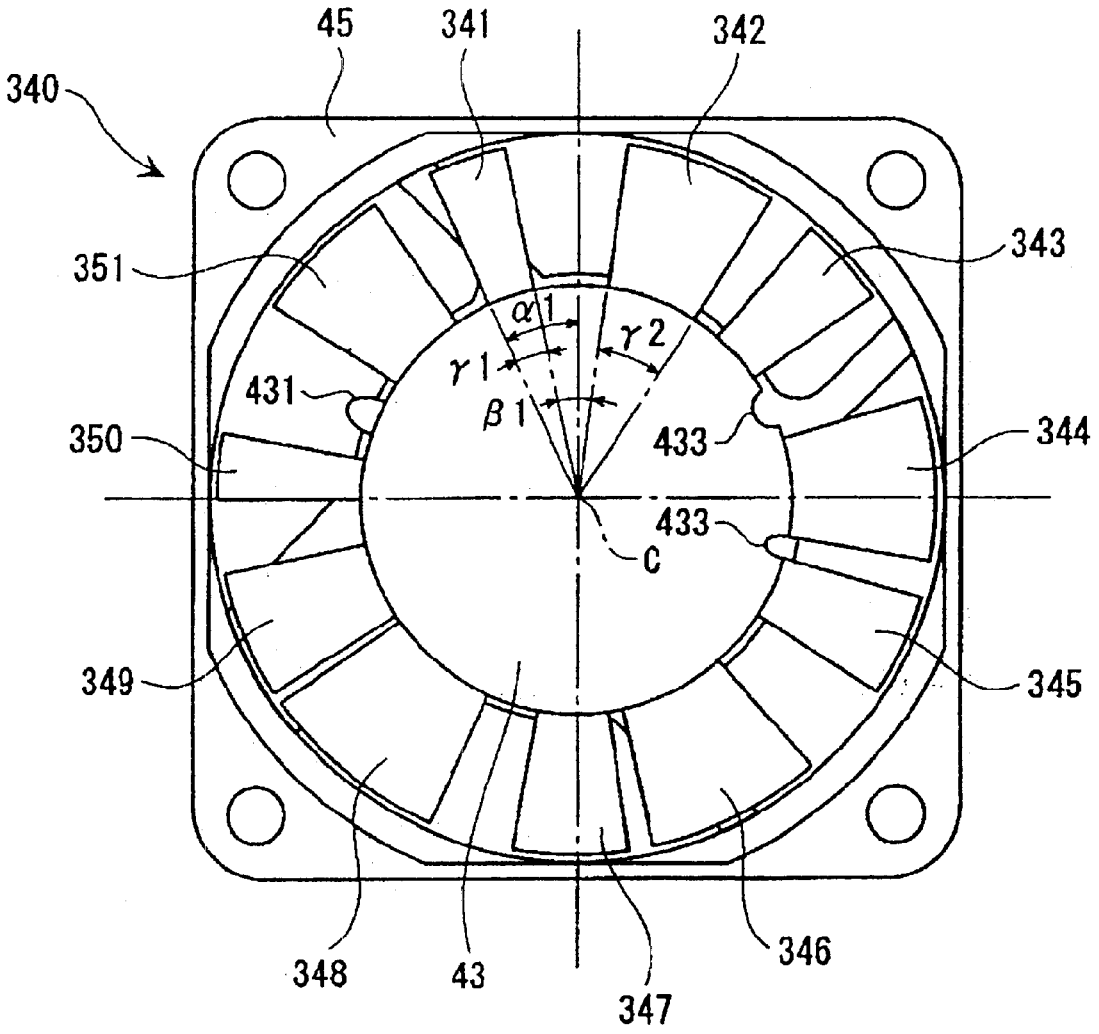
FIG. 11 is a plan view showing the construction of an axial fan of another exemplary embodiment of the present invention.

In contrast, as shown in FIG. 11, in an axial fan 340 of the second embodiment, the angle width of some of the 11 blades 341–351, for instance, the angle width $\gamma 2$ of the blade 342 is set to be larger than the angle width $\gamma 1$ of the blade 341 so that the planar shape of the blade 342 in a plane perpendicular to the rotation axis is thus varied. In the exemplary embodiment, the layout pitches of the blades 341–351 are set to be different as in the first exemplary embodiment. Alternatively, the plurality of the blades may be arranged about the rotation axis at an equal pitch, the angle spacing between adjacent blades β1, for instance, may be adjusted, and the angle width γ1 may be modified.

The constant angle width γ of the blades 341–351 of the axial fan 340 is now determined. The maximum value of the constant angle width with respect to the blade support member 43 is set. In accordance with the maximum value of the constant angle width, the constant angle width γ is gradually reduced, thereby adjusting the layout pitch. The fixed angle width γ of the blades 341–351 is set to be smaller than (360°−2×11)/11 blades=30.7°/blade. The layout diversity of the blades 341–351 around the rotation axis C is thus introduced. The minimum value of the fixed angle width of the blade is determined to assure sufficient strength thereof.

If the blades 341–351 thus designed are rotated with the drive motor rotating within the blade support member 43, a poor weight balance around the rotation axis C can generate the clattering noise. Referring to FIG. 11, the weight balance of the blade support member 43 and the blades 341–351 around the rotation axis C may be assured, by forming a projection 431 on the blade support member 43 where the blades 341–351 are coarsely arranged, and by forming a notch 433 inwardly aligned to the rotation axis C, on the blade support member 43 where the blades 341–351 are closely arranged. The projection 431 and the notch 433 serve as the eccentricity adjusting device. The eccentricity adjusting device assure that the blades 341–351 and the blade support member 43 reliably rotate about the rotation axis C with a well weight balance maintained. The blade support member 43 and the blades 341–351 may be manufactured into a one-piece plastic construction through injection molding. In this case, the blade support member 43 is loaded with a weight or is notched to confirm the configuration that results in a good weight balance, and an injection mold tool is modified to reflect the configuration. As a result, the projection 431 and the notch 433 are formed concurrently with the forming process of the blade support member 43.

Besides the advantages of the first exemplary embodiment, the second exemplary embodiment provides the following advantages.

5) Since the planar shape of the blade 342, out of the blades 341–351, projected onto a plane perpendicular to the rotation axis C is different from that of the blade 341, the generation of the whirring sound is controlled in the same way as in the first exemplary embodiment. A low-noise axial fan 340 may thus result.

6) Beside the varied pitch design, the axial fan has the varied angle width of the blade. This arrangement provides a substantially increased design freedom. An axial fan with the whirring sound controlled and flexible in configuration and specifications is thus manufactured.

7) To assure the weight balance, not only the layout pitch angles α1–α11 around the rotation axis C is adjusted, but also the eccentricity adjusting device, such as the projection 431 and the notch 433, is employed. The weight balance of the blade support member 43 and the blades 341–345 around the rotation axis C may be even more easily adjusted. The design of the axial fan 340 is simplified. This is also true of the first exemplary embodiment.

(9) Construction and Advantages of an Exemplary Embodiment

A third exemplary embodiment of the present invention is now discussed.

In the second exemplary embodiment, the planar shape of the blade 342 is different from that of the blade 341 in a plane perpendicular to the rotation axis C of the blades 341–351 so that the layout diversity is assured to reduce the blade whirring sound level.

Figure 12:
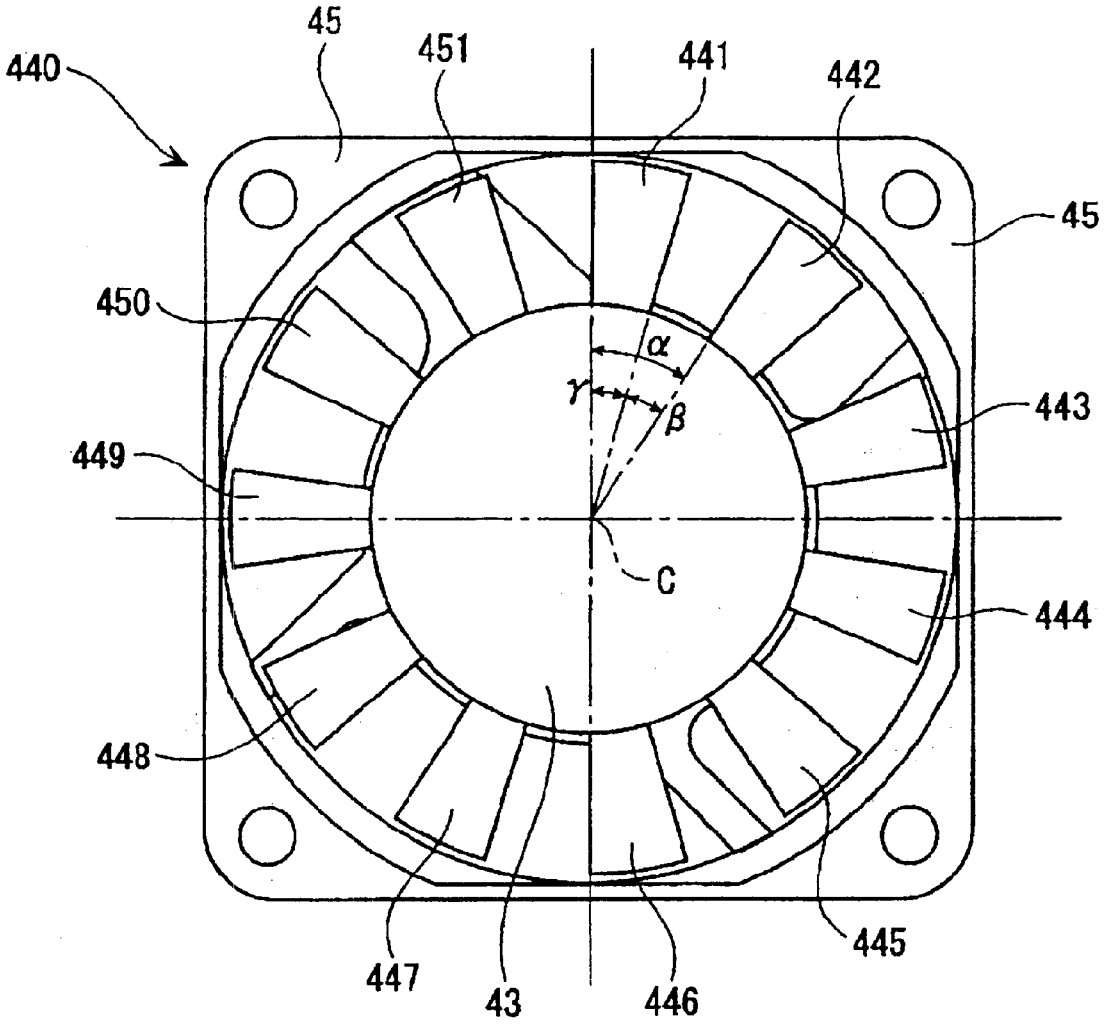
FIG. 12 is a plan view showing the construction of an axial fan of another exemplary embodiment of the present invention.

In contrast, as shown in FIG. 12, an axial fan 440 of the third exemplary embodiment includes blades 441–451 having the same shape in a plane perpendicular to the rotation axis C, namely, having the same fixed angle width γ, and arranged around the rotation axis C at an equal layout pitch angle α.

Figure 13:
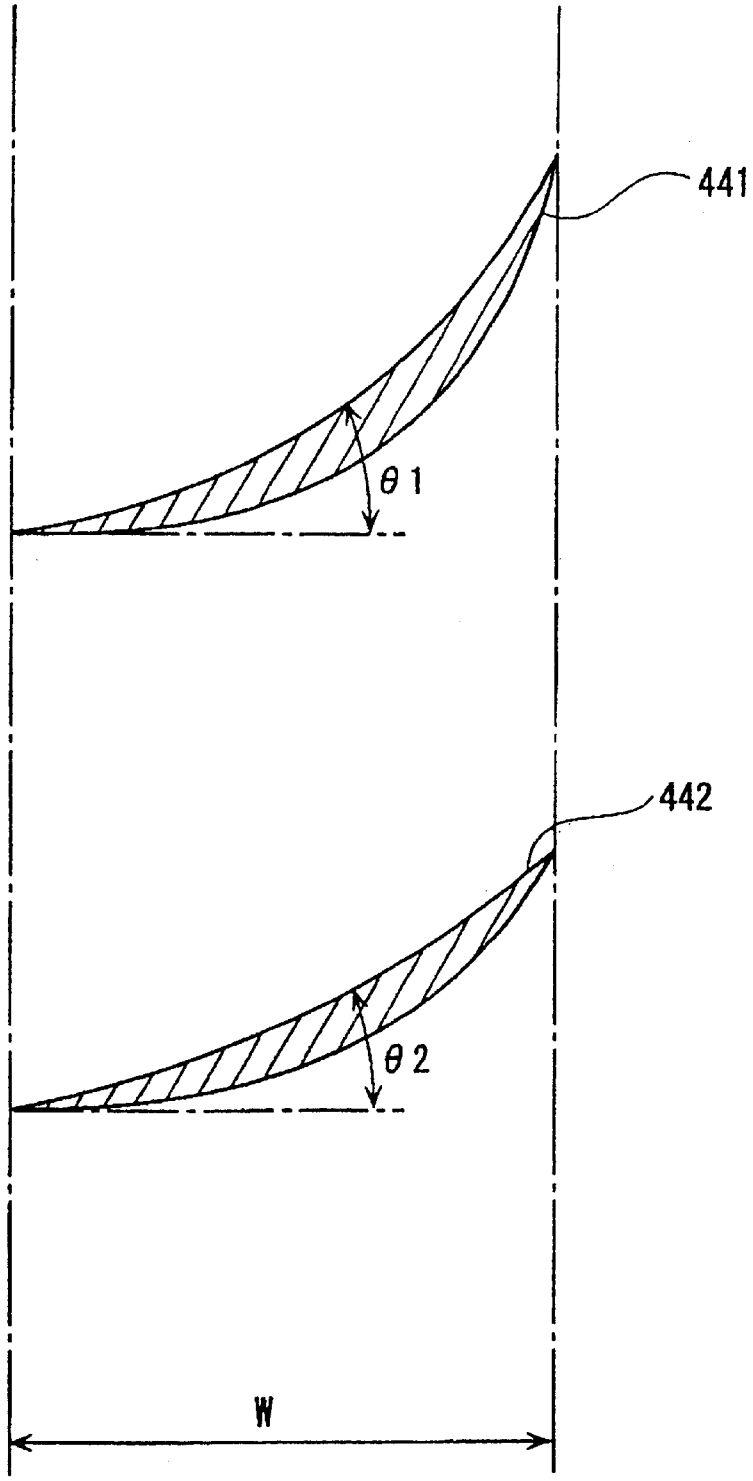
FIG. 13 is a sectional view showing blades of an axial fan of the exemplary embodiment in a plane in which a rotation axis lies.

In this exemplary embodiment, however, some of the blades are different from the remaining blades in cross-sectional shape taken in a plane in which the rotation axis C lies, so that the layout diversity of the blades 441–451 is assured. For instance, if the cross-sectional shapes of the blades 441 and 442 are compared, the two blades 441 and 442 are identical in width dimension W, but the bending angle θ2 of the blade 442 is smaller than the bending angle θ1 of the blade 441 as shown in FIG. 13. By arranging the blades 441–451 having bending angles θ1 and θ2 around the rotation axis C, the layout diversity of the plurality of blades 441–451 is assured. The weight balance around the rotation axis C is assured by arranging the blades 441–451 in balance. Alternatively, the weight balance may be assured by forming a projection and a notch in the blade support member 43.

Since the blades 441–451 are different in cross-sectional shape thereof in the third exemplary embodiment, the layout diversity of the blades 441–451 around the rotation axis C may be assured, thereby reducing the whirring sound. A low-noise axial fan 440 may thus result.

(10) Modifications of the Exemplary Embodiments

The present invention is not limited to the above exemplary embodiments, and includes the following modifications.

Figure 14A:
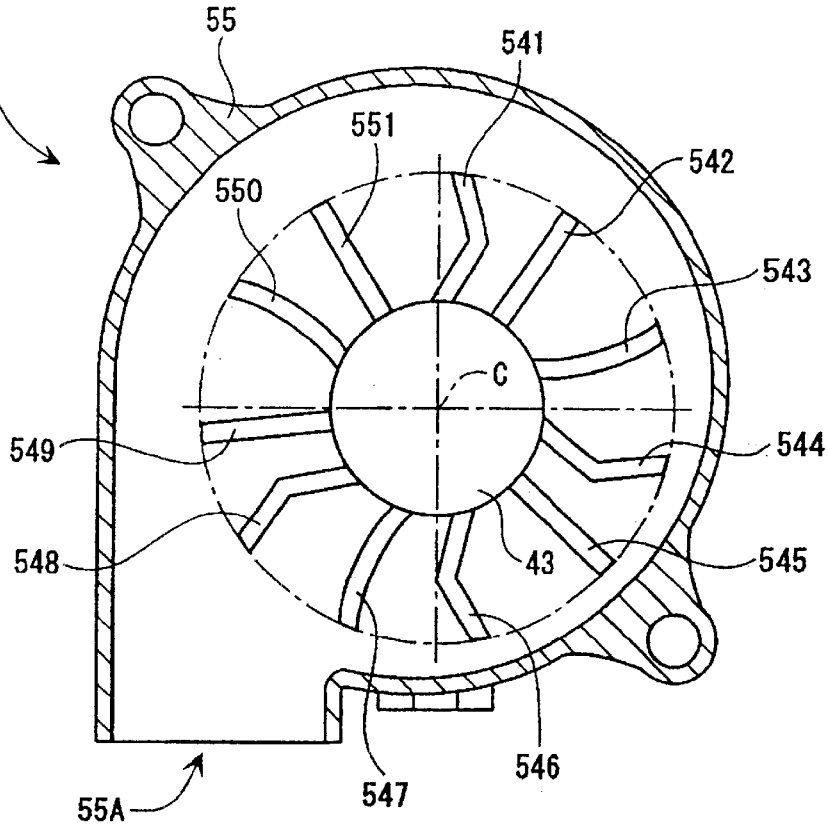
FIG. 14 shows the cross section and side of a centrifugal fan as a modification of each of the above exemplary embodiments.
Figure 14B:
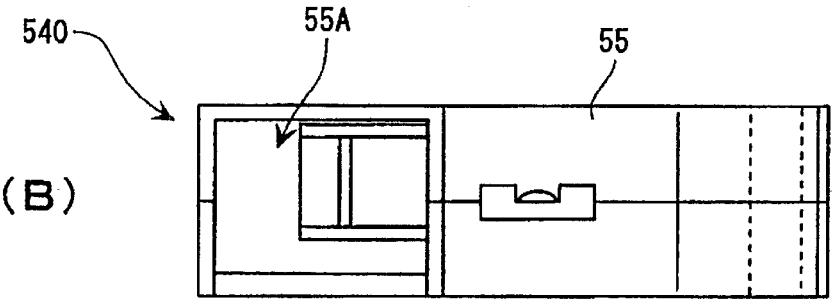

The present invention may be implemented in the axial fans 40, 340, and 440 in the above exemplary embodiments, but if the present invention is implemented in a centrifugal fan 540 shown in FIGS. 14(A)–(B), the same advantages as those of the above exemplary embodiments will be enjoyed. The centrifugal fan 540 includes a blade support member 43, blades 541–551, and a casing 55. The casing 55 includes an opening 55A serving as an exhaust port, and an opening (not shown) arranged on one side in a plane perpendicular to the rotation axis C thereof serving as an air intake port. When the blades 541–551 rotate, air is taken in the rotation axis C from the air intake opening, and air taken is routed in a direction tangential to the rotation of the fan by the blades 541–551, and is then discharged through the opening 55A. Since such a centrifugal fan 540 assures a large quantity of air discharged through the opening 55A, a heat generating electronic component may be efficiently cooled at a small rotational speed when the component is locally cooled. If the above-referenced exemplary embodiments of the present invention are implemented in the centrifugal fan 540, the whirring sound involved may be lowered in level. A low-noise centrifugal fan 540 may thus result.

In the above exemplary embodiments, the axial fan 40, 340, or 440 is employed in the projector 1. The present invention is not limited to the projector 1. The axial fan or the centrifugal fan of the present invention may be incorporated in electronic equipment, if the electronic equipment, such as an overhead projector or a personal computer, is equipped with a heat generating component. The same advantages as those of the above exemplary embodiments may be enjoyed.

The axial fan and the centrifugal fan of the above-reference present invention may lower fan whirring sound in level, becoming low-noise axial fan and centrifugal fan. With these fans incorporated, low-noise electronic equipment may result.

What is claimed is:

1. A centrifugal fan, comprising:

a plurality of blades arranged around a rotation axis at a predetermined layout pitch, the plurality of the blades being rotated about the rotation axis to take in air in a direction of the rotation axis and to discharge the air in a direction tangential to the rotation of the plurality of the blades, and at least some of the plurality of the blades being different from remaining blades in shape projected onto a plane perpendicular to the rotation axis, some of the plurality of blades being linear in shape at cross section, and the remaining plurality of the blades being non-linear in shape at cross section.

2. The centrifugal fan according to claim 1, a number of the plurality of the blades being a prime number.

3. The centrifugal fan according to claim 1, further comprising a weight balancing device that adjusts weight balance around the rotation axis.

4. Electronic equipment comprising the centrifugal fan according to claim 1.

5. A centrifugal fan according to claim 4, a number of the plurality of the blades being a prime number.

6. A centrifugal fan according to claim 4, further comprising a weight balancing device that adjusts weight balance around the rotation axis.

7. A centrifugal fan, comprising:

a plurality of blades arranged around a rotation axis at a predetermined layout pitch, the plurality of the blades being rotated on the rotation axis to take in air in a direction of the rotation axis and to discharge the air in a direction tangential to the rotation of the plurality of the blades, and some of the plurality of the blades being different from remaining blades in layout pitch, some of the plurality of blades being linear in shape at cross section, and the remaining plurality of the blades being non-linear in shape at cross section.

8. The centrifugal fan according to claim 7, a pair of blades generally diametrically symmetrical with respect to the rotation axis among the plurality of the blades having substantially a same layout pitch.

9. The centrifugal fan according to claim 7, a number of the plurality of the blades being a prime number.

10. The centrifugal fan according to claim 7, further comprising a weight balancing device that adjusts weight balance around the rotation axis.

11. Electronic equipment comprising the centrifugal fan according to claim 7.

12. The centrifugal fan according to claim 11, a pair of blades generally diametrically symmetrical with respect to the rotation axis among the plurality of the blades having substantially a same layout pitch.

13. A centrifugal fan according to claim 11, a number of the plurality of the blades being a prime number.

14. A centrifugal fan according to claim 11, further comprising a weight balancing device that adjusts weight balance around the rotation axis.

* * * * *